US010919336B2

(12) United States Patent
Jones et al.

(10) Patent No.: US 10,919,336 B2
(45) Date of Patent: Feb. 16, 2021

(54) STRETCHER FOR A FRAME

(71) Applicant: ColArt International Holdings Ltd, London (GB)

(72) Inventors: Phil Jones, Derbyshire (GB); Keith Curtis, Dorset (GB)

(73) Assignee: COLART INTERNATIONAL HOLDINGS LTD, London (GB)

( * ) Notice: Subject to any disclaimer, the term of this patent is extended or adjusted under 35 U.S.C. 154(b) by 236 days.

(21) Appl. No.: 15/735,899

(22) PCT Filed: May 30, 2016

(86) PCT No.: PCT/EP2016/062151
§ 371 (c)(1),
(2) Date: Dec. 12, 2017

(87) PCT Pub. No.: WO2017/001129
PCT Pub. Date: Jan. 5, 2017

(65) Prior Publication Data

US 2019/0001740 A1 Jan. 3, 2019

(30) Foreign Application Priority Data

Jul. 1, 2015 (SE) ..... 1550934

(51) Int. Cl.
*B44D 3/18* (2006.01)

(52) U.S. Cl.
CPC ..... *B44D 3/185* (2013.01)

(58) Field of Classification Search
CPC ..... B44D 3/185
(Continued)

(56) References Cited

U.S. PATENT DOCUMENTS 339,276 A 4/1886 Dodge
371,933 A * 10/1887 Gray ..... B44D 3/185 160/374.1

(Continued)

FOREIGN PATENT DOCUMENTS

DE 335455 C1 4/1921
DE 9406772 U1 7/1994

(Continued)

OTHER PUBLICATIONS

International Search and Written Opinion from corresponding International Patent Application No. PCT/EP2016/062151, dated Aug. 16, 2016.

(Continued)

*Primary Examiner* — Kyle R Grabowski
(74) *Attorney, Agent, or Firm* — Tucker Ellis LLP

(57) ABSTRACT

The present invention relates to a device for separating first and second abutting frame sections of an assembled canvas frame. The device comprises first (1) and second (2) plate members, wherein the first plate member (1) is adapted for insertion into a groove in the first frame section of the assembled frame, and the second plate member (2) is adapted for insertion into a groove in the second frame section of the assembled frame. The first and second plate members (1, 2) are interconnected and the first plate member (1) is moveable in relation to the second plate member (2). Movement of the first plate member (1) results in separation of the frame sections. The present invention further comprises a method for separating first and second abutting frame sections.

13 Claims, 6 Drawing Sheets

(58) Field of Classification Search
USPC ..... 160/374.1
See application file for complete search history.

(56) References Cited

U.S. PATENT DOCUMENTS

| | | | | | |
|---|---|---|---|---|---|
| 371,934 | A * | 10/1887 | Gray | B44D 3/185 | 160/374.1 |
| 2,149,985 | A * | 3/1939 | Tepper | B44D 3/185 | 160/374.1 |
| 3,291,196 | A * | 12/1966 | Kupersmith | B44D 3/185 | 160/374.1 |
| 3,882,616 | A | 5/1975 | Starzyk | | |
| 4,373,279 | A | 2/1983 | Abel | | |
| 5,052,462 | A * | 10/1991 | Stobart | B44D 3/225 | 160/374.1 |
| 6,138,741 | A * | 10/2000 | Stobart | B44D 3/185 | 160/374.1 |
| 6,163,995 | A * | 12/2000 | Lucchetti | B44D 3/185 | 38/102.1 |
| 8,307,880 | B2 * | 11/2012 | Ocampo | B44D 3/185 | 160/374 |
| 8,936,065 | B1 * | 1/2015 | Gillespie | B44D 3/185 | 160/371 |
| 2009/0057364 | A1 | 3/2009 | Ocampo | | |

FOREIGN PATENT DOCUMENTS

| | | | | |
|---|---|---|---|---|
| EP | 0277107 | A2 | 8/1988 | |
| FR | 348000 | A | 3/1904 | |
| NL | 7612062 | A | 5/1978 | |
| WO | 2012/098231 | A1 | 7/2012 | |
| WO | WO-2012098231 | A1 * | 7/2012 | A47G 1/101 |

OTHER PUBLICATIONS

International Preliminary Report on Patentability from corresponding International Patent Application No. PCT/EP2016/062151, dated Sep. 16, 2017.

Official Action from corresponding Swedish Patent Application No. 1550934-2, dated Jan. 19, 2016.

* cited by examiner

STRETCHER FOR A FRAME

TECHNICAL FIELD

The present invention relates to a device for separating first and second abutting frame sections of an assembled canvas frame, the device comprising first and second interconnected plate members.

BACKGROUND ART

A stretcher is a device used for stretching a canvas mounted on a frame. Conventionally, the stretcher consists of a wooden wedge having an irregular convex pentagonal shape. The wedge is hammered into the frame at one of its corners, i.e. two corners of the wedge are inserted into corresponding grooves arranged in the two abutting frame sections which form the frame corner. The wedge is used to force the abutting frame sections apart, thereby stretching the canvas. However, the use of a hammer is not optimal since there is a significant risk of damaging the canvas when mounting the stretcher. It is also very difficult to adjust the force, applied by the stretcher onto the frame sections and hence canvas, since the stretcher does not have any means for fine adjustment of the pressure applied onto the frame sections. Yet another disadvantage is that the wedge is not easily removed once it has been mounted onto the frame. In order to overcome some of these disadvantages, one needs to turn to specially adapted solutions such as those discussed below.

U.S. Pat. No. 3,882,616 discloses a solution for stretching the canvas wherein two separate wedges cooperate in each frame corner. By pressing each wedge into a groove in abutting frame sections, the frame sections are pressed outwards and away from each other, stretching the canvas. The wedges comprise protrusions which lock them in the desired position. This kind of solution still has several drawbacks, e.g., the wedges are not easily removable once mounted, and multiple wedges are required in each individual frame corner.

FR348000 discloses yet another solution for stretching the canvas mounted on a frame. The device comprises two separate and parallel bars which, when mounted, extend diagonally across the frame between two opposing frame corners, and the ends of the bars are fitted into grooves arranged, at each corner, in abutting frame sections. The bars may be moved, in relation to each other, in the direction of the other frame diagonal by means of a screw and nut arrangement. As the bars are moved away from each other, the canvas is stretched. However, the device is relatively large and requires use of two opposing frame corners, and wherefore pressure can be applied onto only two, of the conventionally four, corners of a frame. Further, the device can only be mounted onto the frame during assembly of the frame, and can, consequently, not be mounted onto, nor be removed from, an already assembled frame.

SUMMARY OF THE INVENTION

It is an object of the present invention to mitigate the above problems, and to provide a device which is operated by means of a single, simple action, which is easily mounted onto a frame, which may be used with conventional, already assembled frames, and which does not jeopardise the integrity of the canvas.

According to a first aspect of the present invention, these objects are achieved by a device for separating first and second abutting frame sections of an assembled canvas frame, the device comprising first and second plate members, the first plate member being adapted for insertion into a groove in the first frame section of the assembled frame, and the second plate member being adapted for insertion into a groove in the second frame section of the assembled frame, wherein the first and second plate members are interconnected and the first plate member is moveable in relation to the second plate member, and wherein movement of the at least one plate member results in separation of said frame sections.

The use of interconnected plate members, which move in relation to each other, facilitates mounting of the device on a conventional standard frame. Only one simple operation is required to insert and lock the device into the grooves of the frame. The device is easily mounted onto an already assembled frame, minimising the risk of damaging the canvas on the frame. Further, the plate members of the device may be fitted into conventional grooves, which are usually provided at each end of a frame section, and intended to accommodate a conventional wooden wedge.

In one embodiment, the second plate member is also moveable, resulting in separation of said frame sections. This facilitates an even separation.

The device may be adapted for being detachably mounted in one corner of the assembled frame, the corner being formed by the first and second frame sections. The compact design of the device limits its extension to only one corner, such that it does not take up unnecessary space and does not affect the other corners of the frame. The user is free to separate the frame sections of only one corner, if so desired, or to separate the frame sections of any desired number of corners, by using one device per corner. Also, the degree of separation of the frame sections can be adjusted to the requirements of each individual corner. Further, the device may be used in frames of all different sizes since there are no restrictions relating to the dimensions of the individual frame sections.

Further, the device may be adapted for being mounted in a corner formed by only two abutting frame sections, arranged at an angle towards each other.

The first and second plate members may overlap at least partially, facilitating an as compact device as possible.

In one embodiment, the plate members are interconnected by means of an excenter mechanism, and the movement of the plate member(s) is executed by turning the excenter mechanism. The excenter solution is well-tried out and reliable, and allows the user to adjust the movement of the plate members, in relation to each other, by means of one simple movement.

The plate members may be locked in relation to each other by means of the excenter mechanism, in cooperation with the grooves, such that the plate members are easily and firmly secured in a desired position.

In another embodiment, the plate members are interconnected by means of a pin, and the movement of the plate member(s) is executed by rotating at least one of the first and second plate members around the pin. Rotation around a pin is a very simple solution, which allows the user to adjust the movement of the plate members, in relation to each other, by means of one simple movement and without using any auxiliary equipment, i.e. simply by hand.

The plate members may be locked in relation to each other by means of a ratchet mechanism arranged on the plate members, such that the plate members are easily and firmly secured, in relation to each other, in a desired, predetermined position.

In a further embodiment, the plate members are interconnected by means of an intermediate piece, and the movement of the plate member(s) is executed by turning a screw arranged in the intermediate piece. When using an intermediate piece, more surface area is provided e.g. for printing of brands or text, while still allowing the user to adjust the movement of the plate members, in relation to each other, by means of one simple movement.

The plate members may be locked in relation to each other by means of the screw, in cooperation with the grooves, such that the plate members are easily and firmly secured in a desired position.

According to a second aspect of the present invention, these objects are achieved by a method of separating first and second abutting frame sections of an assembled canvas frame by means of the device which is described above, comprising the steps of: inserting a first plate member into a groove in a first frame section of the assembled frame, inserting a second plate member into a groove in a second frame section of the assembled frame, and moving at least one plate member in relation to the other plate member, resulting in separation of the frame sections.

The use of interconnected plate members which move in relation to each other facilitates mounting of the device on a frame. One simple operation is all it takes to insert and lock the device into the grooves of the frame.

In one embodiment, the step of moving the plate member(s) comprises turning an excenter mechanism until a desired position has been reached for the plate members, the excenter mechanism locking the plate members in the position in cooperation with the grooves. This allows the user to adjust the movement of the plate members, in relation to each other, by one simple movement, and by means of a well-tried out and reliable solution.

In another embodiment, the step of moving the plate member(s) further comprises locking the plate members in position by means of a ratchet mechanism. This allows the user to adjust the movement of the plate members, in relation to each other, by one simple movement and without use of any auxiliary equipment.

In a further embodiment, the step of moving the plate member(s) comprises turning a screw, arranged in an intermediate piece, such that the screw pushes onto the plate members until a desired position has been reached for the plate members, the screw locking the plate members in position in cooperation with the grooves. This allows the user to adjust the movement of the plate members, in relation to each other, by one simple movement, while also having more surface area, e.g., for print.

The method may also comprise the step of moving at least one of the plate members back towards an initial position, allowing reverse movement of the frame sections such that they are no longer separated, where after the device may be removed from the frame. Hence, the device may be easily removed from the frame, minimising the risk of damaging the canvas of the frame.

Generally, all terms used in the claims are to be interpreted according to their ordinary meaning in the technical field, unless explicitly defined otherwise herein. All references to "a/an/the [element, device, component, means, etc.]" are to be interpreted openly as referring to at least one instance of said element, device, component, means, etc., unless explicitly stated otherwise. Further, by the term "comprising" it is meant "comprising but not limited to" throughout the application.

BRIEF DESCRIPTION OF THE DRAWINGS

This and other aspects of the present invention will now be described in more detail, with reference to the appended drawings showing currently preferred embodiments of the invention.

DETAILED DESCRIPTION

A conventional, rectangular canvas frame comprises of four, essentially straight frame sections. Each corner of the frame is formed by the abutting ends of two frame sections 27*a*, 27*b*, each such pair of frame sections being arranged at an angle, preferably 90°, towards each other. The frame sections are usually fitted together by means of a tongue-and-groove solution arranged at the above mentioned abutting ends of two frame sections. All frame sections are locked in place, and forming a complete frame, by means of the canvas which is stretched over and fasted onto the frame sections.

Each end of each frame section is also provided with an additional groove, intended to accommodate a part of a stretcher. The stretcher is conventionally a wedge, having an irregular convex pentagonal shape, which is inserted into the previously mentioned additional grooves of the abutting frame sections 27*a*, 27*b*. Usually, one or several frame corners are provided with such a stretcher in order to separate the abutting frame sections 27*a*, 27*b* of each specific corner, leading to stretching of the canvas. The canvas may need stretching since it has a natural tendency to stretch and sag over time. Stretchers are also used to eliminate distortion of, or wrinkle lines on, the surface of the canvas due to a change in angle between the frame sections.

FIGS. 1, 2*a*, 2*b*, and 3 show a stretcher 26 according to one embodiment, i.e., a stretcher comprising two plate members which are interconnected and partially covered by each other. By interconnected is meant that the plate members are, permanently or semi permanently, mounted or attached to each other such that they are not easily separated.

E.g., such an interconnection may be achieved by one or several components such as a screw, a stud, or a bolt, or any other intermediate means which connects the two plate members but still allows movement of the plate members in relation to each other. By partially covered is meant that the plate members overlap each other, at least partially, at all times or most of the time.

Figure 1:
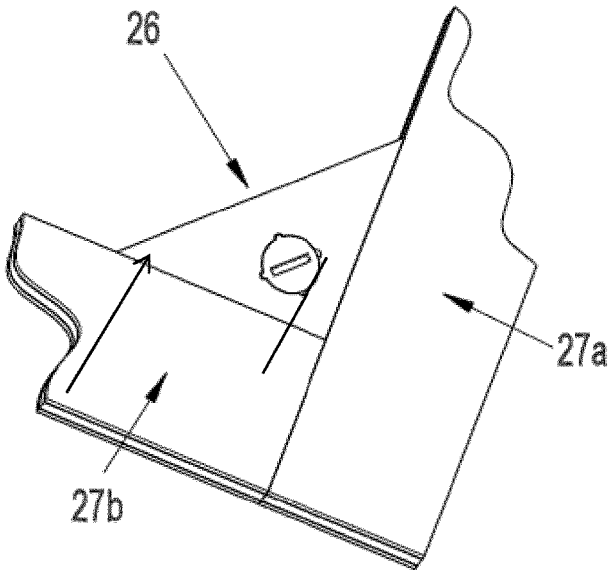
FIG. 1 shows a frame provided with a device according to an embodiment of the present invention.
Figure 2A:
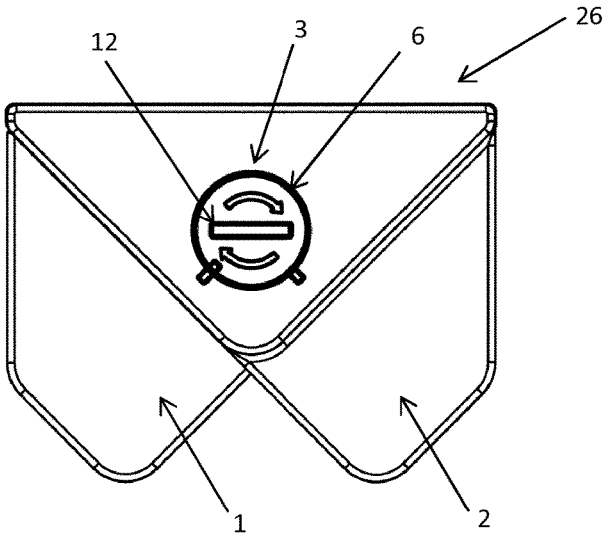
FIGS. 2*a* and 2*b* show a front and a rear view, respectively, of a device according to an embodiment of the present invention.
Figure 2B:
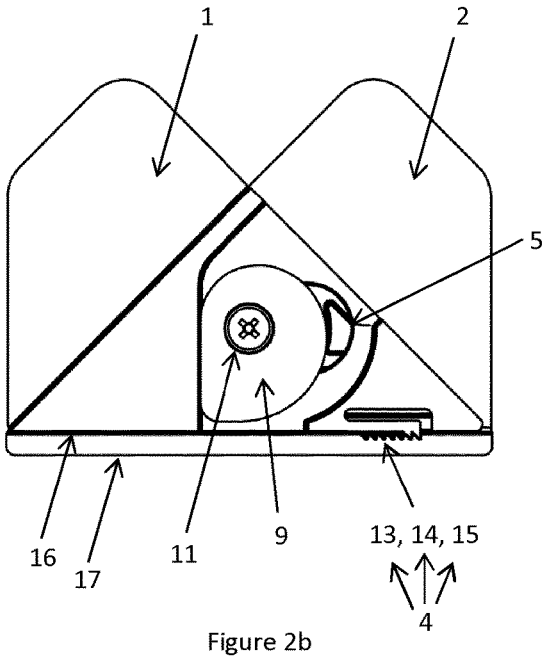
Figure 3:
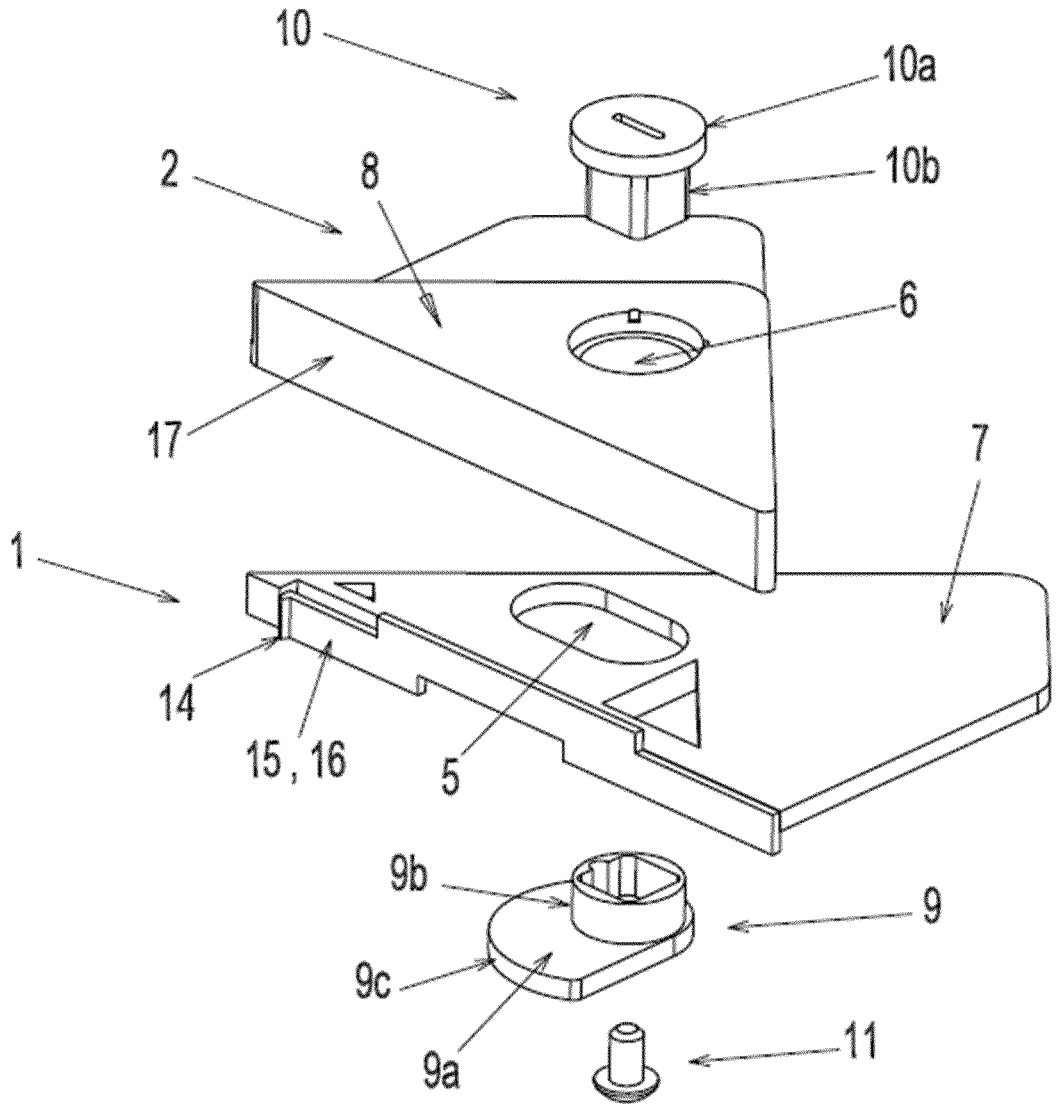
FIG. 3 shows an exploded view of the embodiment shown in FIGS. 2*a*-2*b*.
Figure 4A:
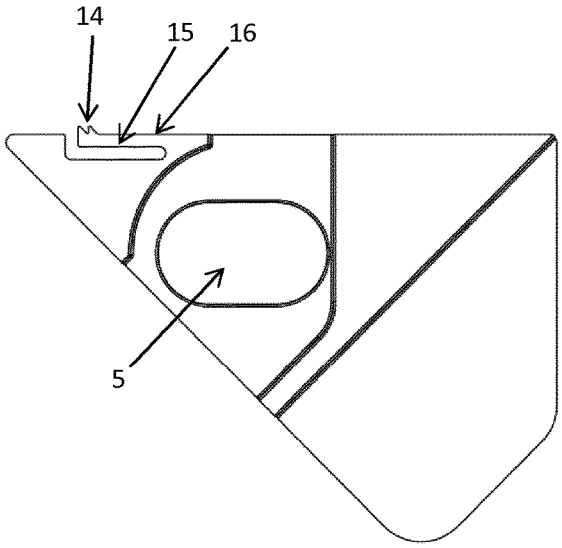
FIGS. 4*a* and 4*b* show a front and a rear view, respectively, of a first plate member for the device shown in FIGS. 2-3.
Figure 4B:
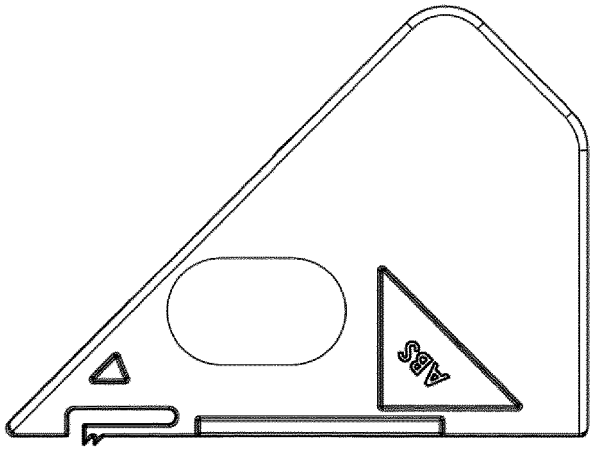
Figure 5A:
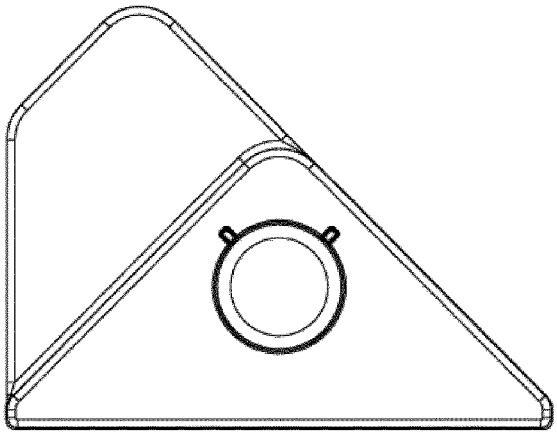
FIGS. 5*a* and 5*b* show a front and a rear view, respectively, of a second plate member for the device shown in FIGS. 2-3.
Figure 5B:
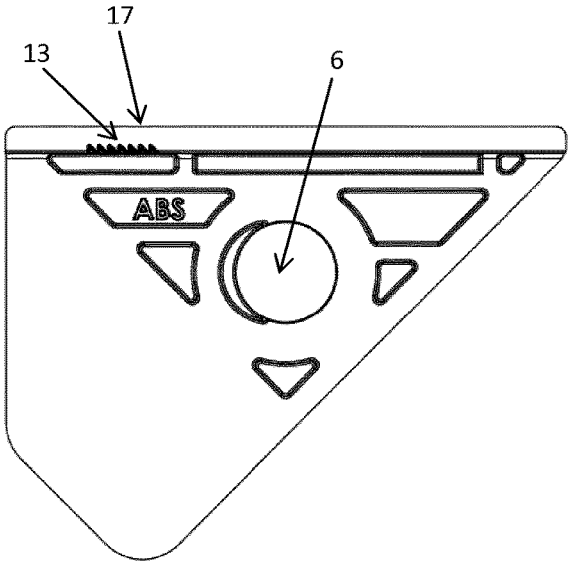
Figure 6A:
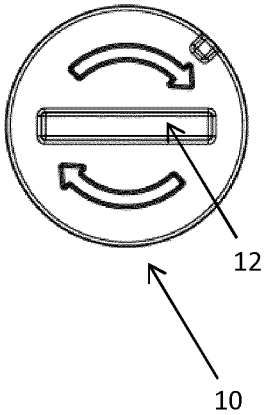
FIGS. 6*a*, 6*b*, and 6*c* show a top view, a sectional side view, and a bottom view, respectively, of an excenter screw for the device shown in FIGS. 2-3.
Figure 6B:
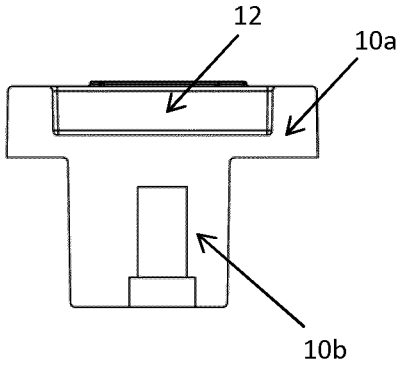
Figure 6C:
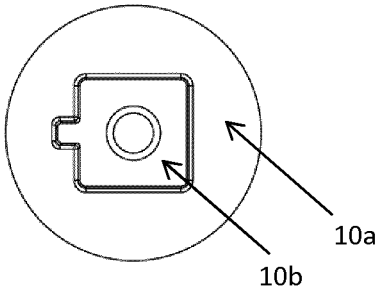
Figure 7A:
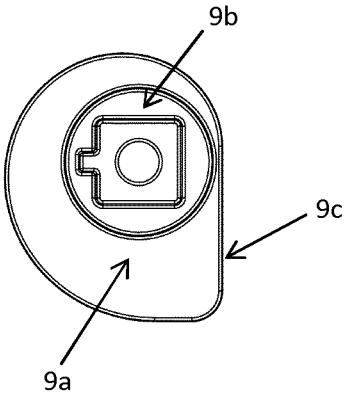
FIGS. 7*a* and 7*b* show a bottom view and a sectional side view, respectively, of an excenter cam for the device shown in FIGS. 2-3.
Figure 7B:
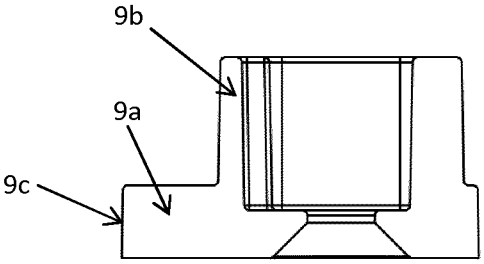

One of the plate members, referred to as the first plate member 1 below, is provided with an elongate through hole 5, shown more clearly in FIGS. 4*a* and 4*b*. The other plate member, referred to as the second plate member 2 below, is provided with an essentially circular through hole 6, shown more clearly in FIGS. 5*a* and 5*b*. Both plate members 1, 2 have varying heights across their main surfaces 7, 8 such that a stepped surface is formed. The plate members 1, 2 are interconnected by means of an excenter mechanism 3 extending perpendicularly to the main surfaces 7, 8 of the plate members 1, 2, and through both through holes 5, 6 such that the two plate members 1, 2 are locked together in an abutting position.

The excenter mechanism 3 comprises an excenter cam 9, an excenter screw 10, and a fastening pin 11, see more clearly in FIGS. 3, 6*a*-6*c*, and 7*a*-7*b*. The excenter cam 9 comprises an elongate disc 9*a*, being roughly D-shaped, and a hollow cylinder 9*b* extending from, and perpendicularly to, the D-shaped disc 9*a*. The hollow cylinder 9*b* fits into the elongate through hole 5 of the first plate member 1 such that the elongate disc 9*a* abuts one side of the first plate member 1, while the free end of the hollow cylinder 9*b* extends, through the through hole 5, to the opposite side of the first plate member 1. The excenter screw 10, having a conventional screw shape with a screw head 10*a* and a screw pin 10*b*, is adapted to fit into the circular through hole 6 of the second plate member 2, through to the opposite side of the second plate member 2 and into the interior of the hollow cylinder 9*b* of the excenter cam 9. The screw pin 10*b*, projecting perpendicularly from the surface of the screw head 10*a*, has a preferably square outer periphery while the hollow cylinder 9*b* of the excenter cam has a corresponding, preferably square, inner periphery, such that the excenter screw 10 and excenter cam 9 can lock together. Of course, other corresponding and interlocking shapes are possible. The fastening pin 11 projects into the D-shaped disc 9*a* of the excenter cam 9 from the side which is opposite to that of the hollow cylinder 9*b*, and interlocks with the excenter screw 10.

The screw head 10*a* of the excenter screw 10 is provided with a rectangular groove 12 for accommodating, e.g., the head of a screwdriver. A screwdriver is used for turning the excenter screw 10, which in turn rotates the excenter cam 9. The screw head 10*a* is rotated more or less completely within the circular through hole 6. Due to the irregular shape of the elongate disc 9*a* of the excenter cam 9 and the elongate through hole 5, the first plate member 1 is moved in an outwards direction away from the second plate member 2 when the excenter screw 10 and excenter cam 9 are rotated in a clockwise direction. The excenter screw 10 and excenter cam 9 may be rotated maximally % of a turn, at which end point the first plate member 1 protrudes maximally in an outwards direction, i.e., in a direction away from the second plate member 2.

The excenter mechanism 3 works in a conventional excenter manner, which is described somewhat more in detail as follows. The D-shaped disc 9*a* of the excenter cam 9 is, as previously mentioned, connected to a hollow cylinder 9*b*. The hollow cylinder 9*b* is offset such that the centre axis of the cylinder is spaced from, but parallel to, the centre axis of the D-shaped disc 9*a*. The outer peripheral edge 9*c* of the disc is in constant contact with an inner peripheral edge of the first plate member 1 such that the rotation of the excenter cam 9 forces the plate members 1, 2 to move in opposite directions, decreasing the plate member overlap and increasing the width of the stretcher 26.

In other words, the width of the stretcher 26 is adjustable. When the first plate member 1 is in its initial position, i.e., retracted as far as possible towards the second plate member 2 and having an as large overlap with the second plate member 2 as possible, the stretcher is at its narrowest, and it may be easily fitted into the grooves provided in the assembled frame. When the first plate member 1 is in the opposite end position, i.e. when the excenter cam 9 has been turned a full % turn and the first plate member 1 protrudes maximally from the second plate member 2, the stretcher is at its widest. In this position, the plate members 1, 2 are fitted so tightly into the grooves in the frame that they push the frame sections 27*a*, 27*b* away from each other, i.e., the abutting frame sections are separated and therefore the canvas arranged on the frame is stretched.

The stretcher 26 is locked firmly into a corner of the frame by means of cooperation between the excenter mechanism 3 and the grooves of the frame sections 27*a*, 27*b*. The actual protrusion of the first plate member 1 corresponds to how much the excenter cam 9 has been turned. The first plate member 1 does not reverse back to the initial position by itself, since the excenter mechanism 3 is essentially locked in place, i.e. the excenter cam 9 and excenter screw 10 do not rotate counter clockwise without the influence of external means such as a screwdriver. The protrusion of the first plate member 1, and hence the rotation of the excenter cam 9, may also be limited by the depth of the groove into which it is inserted.

The stretcher 26 is provided with a ratchet mechanism 4 in order to lock the plate members 1, 2 into place even more firmly. The second plate member 2 is provided with a row of teeth 13, while the first plate member 1 is provided, on a corresponding location, with a hook 14 for locking engagement with the depressions formed between the teeth 13 on the second plate member 2. The hook 14 is preferably arranged on a tongue 15, i.e., a section of the first plate member 1 is provided with a slit in the vicinity of the hook 14 such that the hook 14 may yield somewhat. The ratchet mechanism 4 is preferably arranged at corresponding edges 16, 17 of the plate members 1, 2, at the edges which are opposite the sections of the plate members 1, 2 which are to be inserted into the grooves. The slit extends essentially in parallel with the edge 16 of the first plate member 1, such that the tongue 15 may yield in a direction which is perpendicular to the edge 16 of the first plate member 1.

Even though the stretcher 26 is firmly arranged within the grooves in the frame sections 27*a*, 27*b*, it may still be removed. Firstly, the ratchet mechanism 4 is released by pushing the hook tongue 15 such that the hook 14 of the first plate member 1 is released from the teeth 13 of the second plate member 2. Secondly, the excenter screw 10 and excenter cam 9 are rotated, by means of a screwdriver, counter clockwise back towards their initial position. This way, the first plate member 1 is retracted as far as possible towards, and overlapping as much as possible with, the second plate member 2, and the stretcher 26 may subsequently be removed from the grooves in the frame.

Figure 8A:
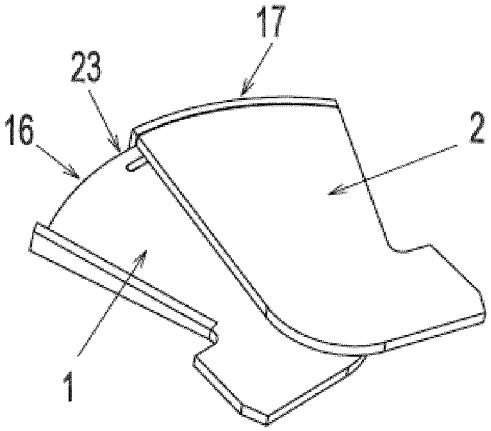
FIGS. 8*a* and 8*b* show a perspective front view and a perspective rear view, respectively, of a device according to a second embodiment of the present invention.
Figure 8B:
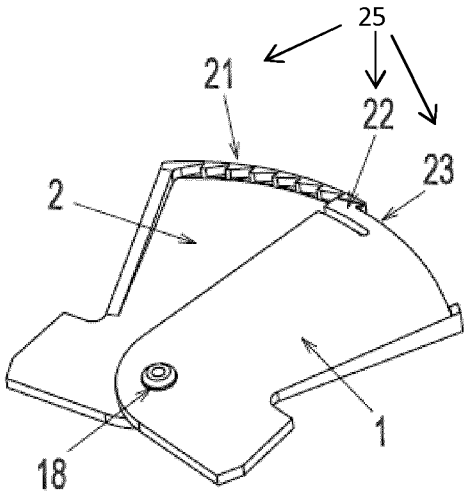
Figure 8C:
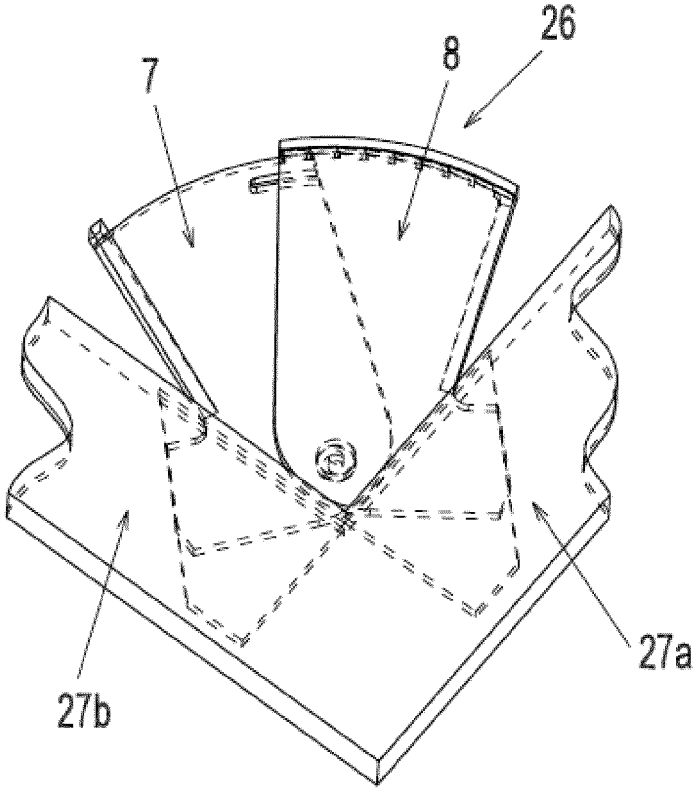
FIG. 8*c* shows a perspective view of the embodiment shown in FIGS. 8*a*-8*b*, the device being arranged in a frame.

FIGS. 8*a*, 8*b*, and 8*c* show a stretcher 26 according to another embodiment, comprising two plate members 1, 2 each having roughly an L-shape with one short leg and one long leg. The two L-shapes are arranged with their backs toward each other, i.e., with the long legs pointing in the same direction and partially overlapping. The plate members 1, 2 are interconnected, at this overlap, by means of a pin 18 which protrudes perpendicularly to the main surfaces 7, 8 of the plate members 1, 2, and through the main surfaces of the plate members. The pin 18 is arranged approximately at the junction between the short and long legs of the L-shape, and the plate members 1, 2 are connected at the pin 18 such that the two short legs of the plate members 1, 2 point essentially in opposite directions while the two long legs of the plate members 1, 2 point essentially in the same direction, perpendicular to the short legs.

The stretcher 26 is provided with a ratchet mechanism 25, such that the plate members may interlock with each other. More exactly, the second plate member 2 is provided with a row of teeth 21, while the first plate member 1 is provided, on a corresponding location, with a hook 22 for locking engagement with the depressions formed between the teeth 21 on the second plate member 2. The hook 22 is preferably arranged on a tongue 23, i.e. a section of the first plate member 1 is provided with a slit in the vicinity of the hook 22, such that the hook 22 may yield somewhat in the direction of the long legs. The ratchet mechanism 25 is preferably arranged at the very edges 16, 17 of the free ends of the two longer legs, i.e. as far as possible from the interconnecting pin 18.

The plate members 1, 2 are moved by simply rotating at least one of the plate members around the pin 18, i.e., pressing the long legs together. When the plate members 1, 2 have the smallest possible overlapping area, in the initial position, the short legs project as little as possible in opposite directions. I.e., the stretcher 26 is at its narrowest, and may be easily fitted into the grooves provided in the frame. When the plate members 1, 2 have the largest possible overlapping area, the short legs project as much as possible in opposite directions, and the stretcher 26 is at its widest. In this position, the short legs of the stretcher are fitted so tightly into the grooves that the stretcher pushes the frame sections 27*a*, 27*b* away from each other, i.e. they are separated, and therefore the canvas arranged on the frame is stretched.

In other words, the plate members 1, 2 are rotated such that the angle between the long legs of the plate members, as seen from the pin 18, increases or decreases. The angle is more or less zero when the stretcher is locked into the frame at its maximum width, and the angle is at its largest when the plate members 1, 2 are in the initial position before use.

The stretcher 26 is locked firmly into the corner of the frame by means of cooperation between the ratchet mechanism and the grooves in the frame sections 27*a*, 27*b*. The actual projection of the short legs is a result of how much the long legs have been pressed together, i.e. on the size of the overlapping area. The plate members 1, 2 do not reverse back into initial position by themselves, since the ratchet mechanism 25 locks them into place. The projection of the short legs may also be limited by the depth of the grooves into which they are inserted.

The stretcher 26 can be removed from the frame, after unlocking of the ratchet mechanism 25. The ratchet mechanism may be unlocked by pushing the longer legs of the plate members 1, 2 perpendicularly to the main surfaces 7, 8 of the plate members, i.e. in the direction of the pin 18, in opposite directions, such that the hook 22 slides out from the teeth 21. The ratchet mechanism 25 may also be unlocked by pushing the hook tongue 23 in a direction towards the pin 18, such that the hook 22 is released from the teeth 21. Thereafter the long legs are moved in a direction from each other to the initial position where the overlap is as small as possible.

Figure 9A:
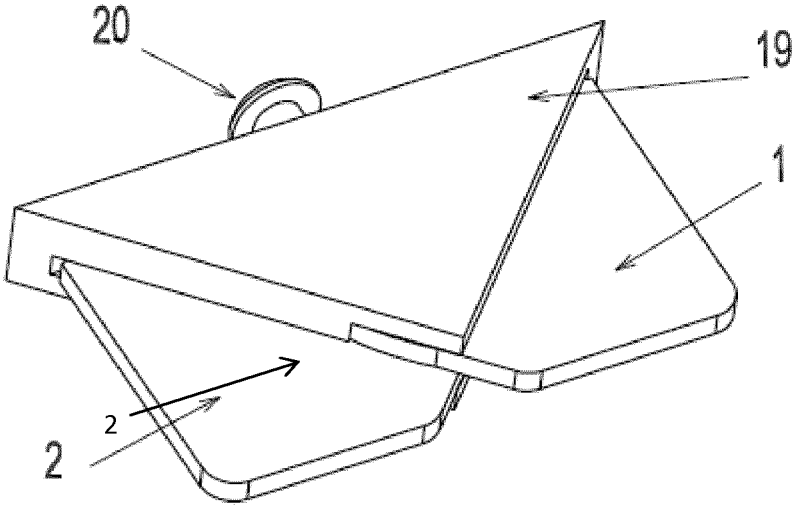
FIG. 9*a* shows a perspective front view of a device according to a third embodiment of the present invention.
Figure 9B:
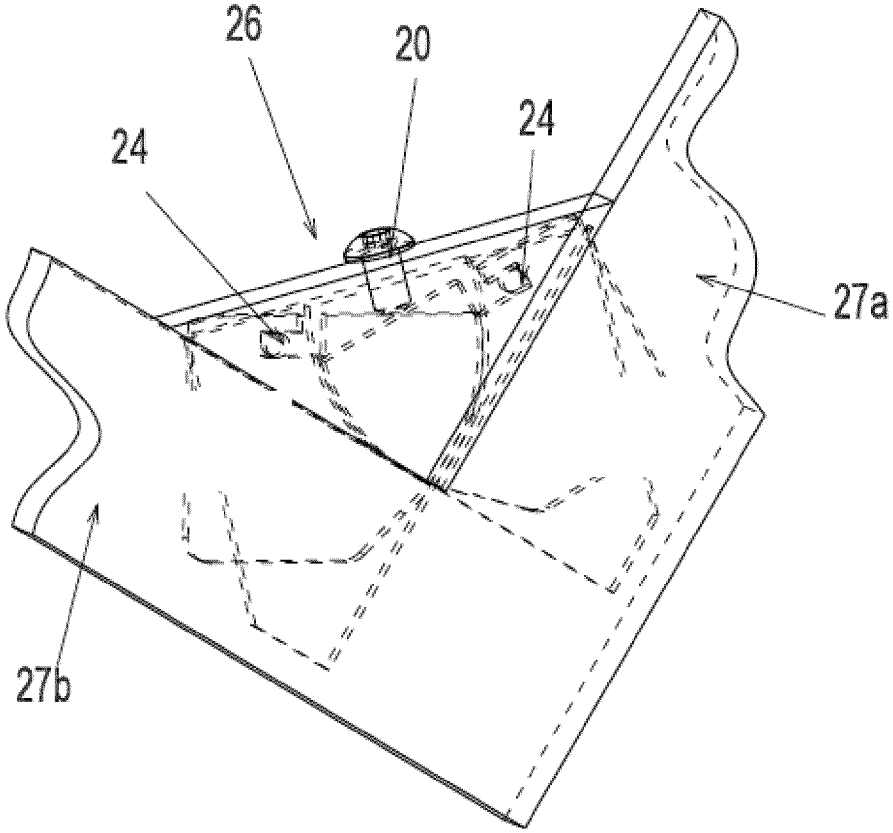
FIG. 9*b* shows a perspective view of the embodiment shown in FIG. 9*a*, the device being arranged in a frame.

FIGS. 9*a* and 9*b* show a stretcher according to yet another embodiment, i.e. a stretcher 26 comprising two plate members 1, 2 connected to, and partially covered by, an intermediate piece 19. The intermediate piece 19 may be triangular in shape with a slit in which the plate members 1, 2 move at least partially. The plate members 1, 2 have roughly a D-shape, and they are connected to opposite ends of the intermediate piece 19. Each plate member 1, 2 is arranged on a pin 24 protruding from the intermediate piece 19 and, at least partially, extending perpendicularly to the main surface 7, 8 of the plate member 1, 2. The plate member 1, 2 is arranged to pivot around the pin 24, sliding more or less into the slit in the intermediate piece 19. The plate members 1, 2 are arranged to always overlap at least partially.

The intermediate piece 19 is provided with a screw 20, used for determining the position of the plate members 1, 2. The screw 20 projects in the plane of the main surfaces 7, 8 of the plate members 1, 2, and is arranged to abut, simultaneously, against one edge of each plate member. The plate members 1, 2 move in response to the movement of the screw 20, i.e. when turning the screw 20 inwards into the intermediate member 19, the screw 20 pushes onto the plate members 1, 2. When the screw 20 pushes onto a plate member 1, 2, the plate member pivots on its pin 24 outwards in a direction from the other plate member 2, 1. Both plate members 1, 2 are pivoted simultaneously, and in an identical manner, by the screw 20.

In other words, the width of the stretcher 26 is adjustable. When the plate members 1, 2 are in initial position, i.e. retracted as far as possible towards each other and into the intermediate piece 19, the stretcher 26 is at its narrowest, and the plate members 1, 2 may be easily fitted into the grooves provided in the frame. When the plate members 1, 2 are in the opposite end position, i.e. when the screw 20 has been screwed completely into the intermediate piece 19 and the plate members 1, 2 protrude maximally in a direction away from each other, the stretcher 26 is at its widest. In this position, the plate members 1, 2 are fitted so tightly into the grooves that the stretcher 26 pushes the frame sections 27*a*, 27*b* away from each other, i.e. they are separated, and therefore the canvas arranged on the frame is stretched.

The stretcher 26 is locked firmly into the corner of the frame by means of cooperation between the screw 20 and the grooves in the frame sections 27*a*, 27*b*. The actual protrusion of the plate members 1, 2 correspond to how much the screw 20 has been turned. The plate members 1, 2 do not reverse back towards each other by themselves, since the screw 20 locks them in place, i.e. the plate members 1, 2 cannot rotate counter clockwise back towards their initial position without the screw 20 being unscrewed. The protrusion of the plate members 1, 2 may also be limited by the depth of the grooves into which they are inserted.

The stretcher 26 is also easily removable from the frame. Even though the stretcher 26 is firmly arranged within the grooves in the frame sections 27*a*, 27*b*, it may be removed by simply turning the screw 20 back towards its initial position, i.e. unscrewing the screw 20 outwards from the intermediate piece 19. This way, the plate members 1, 2 may be folded inwards as far as possible towards each other and into the intermediate member 19, and the stretcher 26 may be withdrawn from the frame sections.

The stretcher 26 is, as discussed above, operated by means of a single action. One stretcher is easily arranged in one corner of the assembled frame, locked into place, and, if necessary later on, removed from the corner by simply reversing the original action. One, or several, corners may be provided with a stretcher, but preferably each individual corner of the frame is provided with a stretcher in order to stabilise the frame as regards, e.g., the angle between the abutting frame sections 27*a*, 27*b*.

The plate members 1, 2 are preferably made of ABS (acrylonitrile butadiene styrene), and the excenter mechanism 3 of PA6.

The person skilled in the art realizes that the present invention by no means is limited to the embodiments described above. On the contrary, many modifications and variations are possible within the scope of the appended claims. For example, the plate members may have any suitable shape and may be interconnected by other means such as a screw or stud. Also, the stretcher may be adapted for use in unconventional polygonal frames. Further, the parts of the stretcher may be made of any suitable material such as a polymer other than those disclosed above. The stretcher may comprise any suitable combination of the individual features disclosed in connection with the above mentioned embodiments.

The invention claimed is:

1. A device for separating first and second abutting frame sections of an assembled canvas frame, the device comprising first and second plate members, and an interconnection member, wherein:

the first plate member is physically configured to be retained in a groove in the first frame section of the assembled frame, and the second plate member is physically configured to be retained in a groove in the second frame section of the assembled frame, the first and second plate members are interconnected by the interconnection member, and the first plate member is moveable in relation to the second plate member, and the movement of the first plate member relative to the second plate member results in separation of the first and second frame sections by the first plate member exerting force on the groove of the first frame section and the second plate member exerting force on the groove of the second frame section, and the first and second plate members overlap at least partially, wherein the plate members are locked in relation to each other by means of a ratchet mechanism arranged on the plate members.

2. The device according to claim 1, wherein also the second plate member is moveable, resulting in separation of the first and second frame sections.

3. The device according to claim 1, wherein the device is detachable from a corner of the assembled frame, the corner being formed by the first and second frame sections.

4. The device according to claim 3, wherein the device is mountable in a corner formed by only two abutting frame sections, arranged at an angle towards each other.

5. The device according to claim 1, wherein the interconnection member is a cam assembly, and rotation of the cam assembly causes the movement of the first plate member relative to the second plate member.

6. The device according to claim 5, wherein the cam assembly and the grooves lock the plate members in relation to each.

7. The device according to claim 1, wherein the interconnection member is a pin, and the movement of the first plate member relative to the second plate member is executed by rotating at least one of the first and second plate members around the pin.

8. The device according to claim 1, wherein the plate members are interconnected by means of an intermediate piece, and the movement of the first plate member relative to the second plate member is executed by turning a screw arranged in the intermediate piece.

9. The device according to claim 8, wherein the plate members are locked in relation to each other by means of the screw, in cooperation with the grooves.

10. A method of separating first and second abutting frame sections of an assembled canvas frame by means of the device according to claim 1, comprising the steps of:

inserting a first plate member into a groove in a first frame section of the assembled frame, inserting a second plate member into a groove in a second frame section of the assembled frame, moving at least one plate member in relation to the other plate member, with at least partial overlap resulting in separation of the first and second frame sections, and wherein the step of moving the at least one plate member further comprises: locking the plate members in a desired position by means of a ratchet mechanism.

11. The method according to claim 10, wherein the interconnection member is a cam assembly, and the step of moving the plate member(s) comprises: turning the cam assembly until a desired position has been reached for the plate members, the cam assembly and the grooves locking the plate members in the desired position.

12. The method according to claim 10, wherein the step of moving the plate member(s) comprises: turning a screw, arranged in an intermediate piece, such that the screw pushes onto the plate members until a desired position has been reached for the plate members, the screw locking the plate members in the desired position in cooperation with the grooves.

13. The method according to claim 10, further comprising the step of:

moving at least one of the plate members back towards an initial position into a narrowest width for the device, allowing reverse movement of the first and second frame sections such that they are no longer separated, where after the device may be removed from the assembled canvas frame.

* * * * *